US008002273B2

(12) United States Patent
Matsumoto et al.

(10) Patent No.: US 8,002,273 B2
(45) Date of Patent: Aug. 23, 2011

(54) PAPER DISCHARGE APPARATUS, POST-PROCESSING APPARATUS, AND IMAGE FORMING APPARATUS

(75) Inventors: Yoshitaka Matsumoto, Osaka (JP); Toyoaki Nanba, Osaka (JP); Masaru Tsuji, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 189 days.

(21) Appl. No.: 12/506,679

(22) Filed: Jul. 21, 2009

(65) Prior Publication Data

US 2010/0019446 A1 Jan. 28, 2010

(30) Foreign Application Priority Data

Jul. 28, 2008 (JP) ..... 2008-193928

(51) Int. Cl.
*B65H 31/00* (2006.01)
*B65H 31/04* (2006.01)

(52) U.S. Cl. ..... 271/209; 271/213

(58) Field of Classification Search ..... 271/213, 271/209

See application file for complete search history.

(56) References Cited

U.S. PATENT DOCUMENTS

| | | | | |
|---|---|---|---|---|
| 7,905,482 | B2 * | 3/2011 | Matsumoto | 271/213 |
| 2006/0202403 | A1 | 9/2006 | Nagata et al. | |
| 2008/0048387 | A1 * | 2/2008 | Matsumoto | 271/207 |

FOREIGN PATENT DOCUMENTS

| | | |
|---|---|---|
| JP | 2-32166 | 2/1990 |
| JP | 2003-182921 | 7/2003 |
| JP | 2006-248685 | 9/2006 |
| JP | 2008-105782 A | 5/2008 |
| JP | 2008-110834 | 5/2008 |

* cited by examiner

*Primary Examiner* — David H Bollinger
(74) *Attorney, Agent, or Firm* — Nixon & Vanderhye, PC

(57) ABSTRACT

A paper discharge apparatus that sequentially discharges paper through a discharge outlet, stacks and stores the paper is provided, the apparatus includes: a discharge tray including a fixed tray that is fixedly disposed spaced apart from the discharge outlet, and a swing tray that is disposed between the fixed tray and the discharge outlet and that is axially supported so as to be capable of swinging at or near an end portion of the fixed tray; and a drive control unit that controls an angle of inclination of a surface of the swing tray with respect to a surface of the fixed tray by swinging the swing tray. In this paper discharge apparatus, paper discharged from the discharge outlet is received on the fixed tray and the swing tray of the discharge tray.

12 Claims, 7 Drawing Sheets

PAPER DISCHARGE APPARATUS, POST-PROCESSING APPARATUS, AND IMAGE FORMING APPARATUS

BACKGROUND OF THE TECHNOLOGY

This application claims priority under 35 U.S.C. §119(a) on Patent Application No. 2008-193928 filed in Japan on Jul. 28, 2008, the entire contents of which are herein incorporated by reference.

The present technology relates to a paper discharge apparatus that sequentially discharges paper through a discharge outlet, and stacks and stores the paper, and a post-processing apparatus and an image forming apparatus that include such a paper discharge apparatus.

This type of paper discharge apparatus is an apparatus that is applied to, for example, an image forming apparatus, such as a copy machine, or a post-processing apparatus for an image forming apparatus, and that sequentially discharges, stacks and stores a plurality of printed or post-processed paper sheets onto a discharge tray.

For example, JP 2006-248685A discloses such a paper discharge apparatus. According to this disclosure, in order to align a plurality of paper sheets on a discharge tray, the discharge tray is inclined with the outermost end side (the downstream side in the paper discharge direction) of the discharge tray upward so that each sheet of paper slides on the discharge tray and one end of the sheet abuts the rear end side of the discharge tray and is aligned.

JP H02-31266U discloses a technique in which a lower guide plate that is disposed on an inclined tray and that is biased horizontally and an upper guide plate that is disposed overlapping the lower guide plate and that is axially supported on the upper side of a paper discharge outlet are provided, and paper is discharged from the discharge outlet onto the lower guide plate and is interposed between the lower guide plate and the upper guide plate while the paper on the lower guide plate is pressed by the weight of the upper guide plate. As the number of paper sheets on the lower guide plate increases, due to the weight of the paper sheets, the lower guide plate is inclined downward against the biasing force until the lower guide plate comes into contact with the inclined tray.

JP 2003-182921A discloses a technique in which a discharge tray and an auxiliary tray that is disposed on the rear end portion (the upstream side portion in the paper discharge direction) of the discharge tray are provided, post-processing is performed on a plurality of paper sheets in a state in which the paper sheets are discharged straddling the discharge tray and the auxiliary tray and, after that, the auxiliary tray is put away so that the paper sheets are placed on the discharge tray with one end of the paper sheets abutting the rear end side of the discharge tray for alignment.

Although various attempts have been made on conventional paper discharge apparatuses so as to properly align the edges of a plurality of paper sheets, none of them addresses the straightening of curl in paper. In an image forming apparatus, paper is heated in a fixing process and, as a result, the paper is curled by that heating. At this time, not only the leading edge and trailing edge of paper are curled, but also both sides of the paper are curled. That is, four edges or corners of the sheet of paper are curled.

Conventionally, there have been no means for effectively straightening such four curled edges or corners of a sheet of paper, so reliance was placed on the phenomenon in which the paper naturally returns to its flat state on the discharge tray.

The present technology has been conceived in view of the above problems encountered with conventional technology, and it is an object of the technology to provide a paper discharge apparatus that is capable of effectively straightening four curled edges or corners of a sheet of paper, and a post-processing apparatus and an image forming apparatus that include such a paper discharge apparatus.

SUMMARY OF THE TECHNOLOGY

In order to solve the above problems, a paper discharge apparatus is a paper discharge apparatus that sequentially discharges paper through a discharge outlet, stacks and stores the paper, the apparatus including: a discharge tray including a fixed tray that is fixedly disposed spaced apart from the discharge outlet, and a swing tray that is disposed between the fixed tray and the discharge outlet and that is axially supported so as to be capable of swinging about an axis provided to an end portion of the fixed tray or near the end portion of the fixed tray; and a drive control unit that controls an angle of inclination of a surface of the swing tray with respect to a surface of the fixed tray by swinging the swing tray, wherein paper discharged from the discharge outlet is received on the fixed tray and the swing tray of the discharge tray.

A fixed tray is fixedly disposed spaced apart from a discharge outlet, and a swing tray disposed near the discharge outlet is axially supported so as to be capable of swinging about an axis provided to an end portion of the fixed tray or near the end portion of the fixed tray. By controlling the angle of inclination of the swing tray with respect to the fixed tray by swinging the swing tray, paper discharged from the discharge outlet is received on the fixed tray and the swing tray. With such control of the angle of inclination of the swing tray with respect to the fixed tray, the paper on a discharge tray that includes the fixed tray and the swing tray can be made flat or buckled by being bent, as a result of which, curl in the paper can be easily and effectively straightened.

In the above configuration, the drive control unit may switch and set a state of the discharge tray between a state before the angle of inclination is changed and a state in which the angle of inclination is changed from that state so as to bend the surface of the swing tray at an inclined angle with respect to the surface of the fixed tray.

In this case, the state of the discharge tray is switched and set between a state before the angle of inclination is changed and a state in which the angle of inclination is changed from that state so as to bend the surface of the swing tray at an inclined angle with respect to the surface of the fixed tray, as a result of which, the paper can be made to buckle. The curled sides of a sheet of paper can be smoothly loosened by buckling the paper in a direction perpendicular to the curled sides and, by doing so, the loosening of the curled leading edge and trailing edge of the paper is also facilitated.

In the above configuration, the state of the discharge tray before the angle of inclination is changed may be a state in which the surface of the discharge tray is flat or nearly flat, and an end portion on the discharge outlet side of the swing tray may be positioned close to the discharge outlet when the discharge tray is held flat or nearly flat, and the end portion on the discharge outlet side of the swing tray may be spaced apart from the discharge outlet when the discharge tray is bent.

In this case, when the state of the discharge tray before the angle of inclination is changed is a state in which the surface of the discharge tray is flat or nearly flat, a discharge-outlet side end portion of the swing tray is positioned close to the discharge outlet, so even if the leading edge of the paper is likely to curl downward, the leading edge of the paper is received on the swing tray before the leading edge of the paper discharged from the discharge outlet curls completely and, thereby, the leading edge of the paper is flattened on the swing tray. Then, when the discharge tray is bent, the paper is buckled in a direction perpendicular to the curled sides of the paper, so curl in the paper can be smoothly loosened, as described above.

In the above configuration, the drive control unit may temporarily switch the state of the discharge tray from a state before the angle of inclination is changed to a state in which the surface of the discharge tray is bent each time paper is discharged from the discharge outlet and, after that, switch the state of the discharge tray back to the state before the angle of inclination is changed.

In this case, each time paper is discharged from the discharge outlet, the state of the discharge tray is temporarily switched from the state before the angle of inclination is changed to a state in which the discharge tray is bent and, after that, the state of the discharge tray is switched back to the state before the angle of inclination is changed. By doing so, curl can be straightened sheet by sheet.

In the above configuration, the drive control unit may temporarily switch the state of the discharge tray from a state before the angle of inclination is changed to a state in which the surface of the discharge tray is bent when a plurality of paper sheets are discharged from the discharge outlet and, after that, switch the state of the discharge tray back to the state before the angle of inclination is changed.

In this case, when a plurality of paper sheets are discharged from the discharge outlet, the state of the discharge tray is temporarily switched from the state before the angle of inclination is changed to a state in which the discharge tray is bent and, after that, the state of the discharge tray is switched back to the state before the angle of inclination is changed. By doing so, curl in a plurality of paper sheets can be straightened collectively.

A post-processing apparatus for use in an image forming apparatus includes the above-described paper discharge apparatus.

Also, an image forming apparatus includes the above-described paper discharge apparatus.

The post-processing apparatus and the image forming apparatus exhibit the same working effects as the above-described paper discharge apparatus as they include the paper discharge apparatus of the described technology.

DESCRIPTION OF EMBODIMENTS

Hereinafter, an embodiment of the technology will be described in detail with reference to the accompanying drawings.

Figure 1:
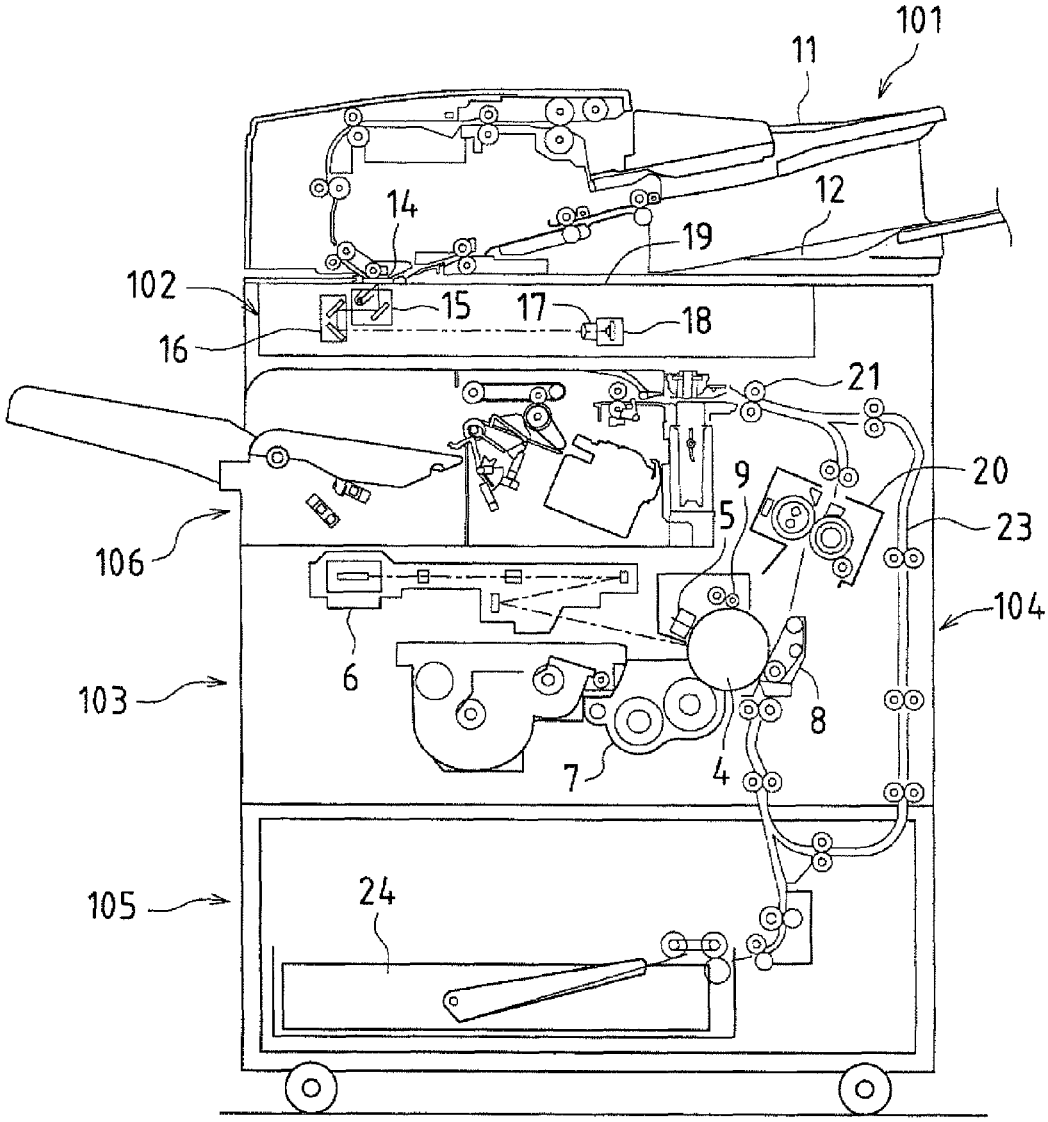
FIG. 1 is a cross-sectional view of an image forming apparatus in which a paper discharge apparatus according to an embodiment of the technology is applied.

FIG. 1 is a cross-sectional view of an image forming apparatus in which a paper discharge apparatus according to an embodiment of the technology is applied. This is an image forming apparatus that acquires image data read from an original or image data received from the outside, and forms a monochrome image represented by such image data on paper. Roughly speaking, the image forming apparatus is configured of an auto document feeder (ADF) 101, an original reader 102, a printer unit 103, a paper convey unit 104, a feeding unit 105, and a post-processing apparatus 106.

In the auto document feeder 101, at least one sheet of an original is placed on an original feed tray 11. The original placed thereon is fed from the original feed tray 11, sheet by sheet, and the original fed therethrough is guided onto a first platen glass 14 of the original reader 102, passes through over the first platen glass 14, and is discharged onto a discharge tray 12.

In the original reader 102, an optical unit that includes a first scanning unit 15 and a second scanning unit 16 is disposed under the first platen glass 14. When the original passes through over the first platen glass 14, the surface of the original is exposed to light by a light source of the first scanning unit 15, the light reflected from the surface of the original is guided by the mirrors of the first and second scanning units 15 and 16 to an imaging lens 17, and an image on the surface of the original is formed on a CCD (Charge Coupled Device) 18 by the imaging lens 17. The CCD 18 repeatedly reads the image on the surface of the original in the main scanning direction, and outputs image data of the image of the surface of the original.

When an original is placed on a second platen glass 19 serving as the top face of the original reader 102, the surface of the original placed on the second platen glass 19 is exposed to light by the first scanning unit 15 while the first and second scanning units 15 and 16 move in the sub-scanning direction, the light reflected from the surface of the original is further reflected by the first and second scanning units 15 and 16 and guided to the imaging lens 17, and an image on the surface of the original is formed on the CCD 18 by the imaging lens 17. At this time, control is performed such that the first and second scanning units 15 and 16 move while maintaining a prescribed speed relationship between the first scanning unit 15 and the second scanning unit 16, and the positional relationship between the first and second scanning units 15 and 16 is constantly maintained such that the length of an optical path of the reflected light including the surface of the original, the first and second scanning units 15 and 16, the imaging lens 17 and the CCD 18 in this order does not change, as a result of which, the focus of an image on the surface of the original is constantly maintained on the CCD 18.

The image data outputted from the CCD 18 is subjected to various image processes by a control circuit such as a microcomputer, and then outputted to the printer unit 103.

Accordingly, the original reader 102 of the present embodiment can perform both an original convey scheme in which an original is conveyed onto the first platen glass 14, and an original fix scheme in which an original is placed on the second platen glass 19 and the optical unit (the first and second scanning units 15 and 16) is moved.

In the printer unit 103, a photosensitive drum 4 is disposed at approximately the center of the printer unit 103, and a charging unit 5, an optical scanning unit 6, a development unit 7, a transfer unit 8, and a cleaning unit 9 are disposed around the photosensitive drum 4.

The charging unit 5 uniformly charges the surface of the photosensitive drum 4. The optical scanning unit 6 inputs image data, modulates a light beam intensity according to the image data, and writes an electrostatic latent image on the uniformly charged photosensitive drum 4 while scanning with light beams. The development unit 7 develops the electrostatic latent image on the photosensitive drum 4 using a developer and forms a developer image on the photosensitive drum 4. The transfer unit 8 conveys paper by interposing the paper between the transfer unit 8 and the photosensitive drum 4, and transfers the developer image on the photosensitive drum 4 onto the paper. The cleaning unit 9 removes the developer left on the photosensitive drum 4 such that a new developer image can be formed on the photosensitive drum 4.

A fixing apparatus 20 is disposed on the upper portion of the printer unit 103. The fixing apparatus 20 receives the paper on which the image has been transferred, interposes the paper between a fixing roller and a pressurizing roller, and fixes the development image that has been transferred onto the paper.

The paper is conveyed upward by conveyance rollers, then conveyed through paper discharge rollers 21 to the post-processing apparatus 106, and discharged via the post-processing apparatus 106.

In the case of forming images on both surfaces of paper, the paper is conveyed in the opposite direction by the paper discharge rollers 21, further conveyed to a reverse conveyance path 23, where the paper is turned over and conveyed again to the printer unit 103, where a developer image is transferred onto the other surface of the paper and fixed. Then, the paper is discharged from the paper discharge rollers 21 via the post-processing apparatus 106.

The feeding unit 105 includes a paper feed tray 24. Paper is separated and supplied from this paper feed tray 24, sheet by sheet, into the region between the photosensitive drum 4 and the transfer unit 8, and the developer image on the photosensitive drum 4 is transferred onto the paper.

The post-processing apparatus 106 is disposed so as to be capable of receiving paper from the paper discharge rollers 21 of the image forming apparatus. When a request to perform post-processing is instructed through an input operation by a user with an operation panel (not shown) of the image forming apparatus, the post-processing request is inputted into a control unit (not shown) of the image forming apparatus, then, in response thereto, the control unit performs control so as to activate the post-processing apparatus 106, which performs post-processing on the paper. Usually, such post-processing performed by the post-processing apparatus 106 is a stapling process, a punching process, or the like.

The configuration of the post-processing apparatus 106 will be described next with reference to FIG. 2. This post-processing apparatus 106 is integrated with a paper discharge apparatus 107 of the present embodiment, and is configured such that paper is discharged via the post-processing apparatus 106 to a discharge tray 31 of the paper discharge apparatus 107.

In the post-processing apparatus 106, the paper conveyed from the paper discharge rollers 21 is introduced through an inlet 32, conveyed via a punching unit 33 to inlet rollers 34, and further conveyed from the inlet rollers 34 via conveyance rollers 35 to a discharge roller 36. When a paper stapling process or the like is not performed, the paper is discharged from a discharge outlet 40 onto the discharge tray 31 by the discharge roller 36 without interrupting the conveyance of the paper. On the other hand, when a paper stapling process or the like is performed, the conveyance of the paper is temporarily stopped by the discharge roller 36, the paper is reversely conveyed to a stapling unit 38 by a drawing belt 37, subjected to a paper stapling process by the stapling unit 38, and then discharged from the discharge outlet 40 onto the discharge tray 31 by the discharge roller 36.

The discharge roller 36 is driven and rotated by the transmission of the rotation driving force of a driving roller 41 via a belt 42. The discharge roller 36 is also supported so as to be capable of rotation about the axis of the driving roller 41 (i.e., with the axis of the driving roller 41 as the center axis), so the discharge roller 36 is driven and rotated about the axis of the driving roller 41 (i.e., with the axis of the driving roller 41 as the center axis) by a driving unit (not shown) and, thereby, it comes into contact with or separates from an idler roller 39.

The drawing belt 37 is driven and rotated together with a conveyance roller 35. The drawing belt 37 is also supported so as to be capable of rotation about the axis thereof (i.e., with its axis as the center), so the drawing belt 37 is driven and rotated about the axis thereof (i.e., with its axis as the center) by a driving unit (not shown) and, thereby, it comes into contact with or separates from a paper placing plate 56.

In order to detect paper, an inlet sensor 51, a passage sensor 52, and a post-process sensor 53 are provided. The inlet sensor 51 is a transmission optical sensor in which a light-emitting element and a light-receiving element are disposed opposite each other, and detects the leading edge and trailing edge of incoming paper introduced from the inlet 32. The passage sensor 52 includes a swing detector 52*a* that swings when the paper comes into contact with the swing detector 52*a*, and an optical sensor 52*b* whose detection output changes according to the position of the swung swing detector 52*a*. A change in the detection output indicates the passage of paper from the inlet 32. The post-process sensor 53 also includes a swing detector 53*a* that swings when the paper comes into contact with the swing detector 53*a*, and an optical sensor 53*b* whose detection output changes according to the position of the swung swing detector 53*a*. A change in the detection output indicates the discharge of a stack of paper sheets from the paper placing plate 56.

Between the discharge roller 36 and the stapling unit 38 is disposed the paper placing plate 56 on which paper reversely conveyed to the stapling unit 38 is placed. On the paper placing plate 56, a pair of guide plates 57 for guiding both sides of a sheet of paper are provided so as to be capable of moving along a direction perpendicular to the direction between both sides of a sheet of paper (a direction perpendicular to the direction in which paper is conveyed).

A paddle 58 is axially supported so as to be capable of rotation, and is driven and rotated in a counterclockwise direction. This paddle 58 is used to press the paper discharged onto the discharge tray 31 and align the paper by drawing the paper toward a rear end 64*a* of the discharge tray 31.

A press lever 61 is axially supported so as to be capable of swinging about its axis 61*a* (i.e., with the axis 61*a* as the center of the rotation axis). The press lever 61 usually rotates counterclockwise under its own weight, and a tip 61*b* of the press lever 61 comes into contact with the discharge tray 31 or the paper discharged on the discharge tray 31. When discharging the paper, the press lever 61 is controlled by a control unit (not shown) so as to swing in a clockwise direction so that the tip 61*b* of the press lever 61 is lifted from the discharge tray 31, and the paper is smoothly discharged onto the discharge tray 31.

In addition, a lower optical sensor 61*c* and an upper optical sensor 61*d* for detecting the position of the swung press lever 61 are provided. When the tip 61*b* of the press lever 61 is moved down to the position at which it comes into contact with the surface of the discharge tray 31 or the top sheet of the paper sheets on the discharge tray 31, the detection output of the upper optical sensor 61*d* changes according to the position of the swung press lever 61. When the lever 61 is controlled so as to swing in a clockwise direction and the tip 61*b* of the press lever 61 is lifted from the discharge tray 31, the detection output of the lower optical sensor 61*c* changes according to the position of the swung press lever 61.

The operating procedures of the post-processing apparatus 106 will be described now with reference to FIGS. 3A to 3D and FIGS. 4A to 4D. When the post-processing apparatus 106 operates, the paper discharge apparatus 107 of the present embodiment operates as well, but the operation of the paper discharge apparatus 107 will be described later.

An operation procedure of the post-processing apparatus 106 when a paper stapling process or the like is not performed will be described first with reference to FIGS. 3A to 3D.

Figure 3A:
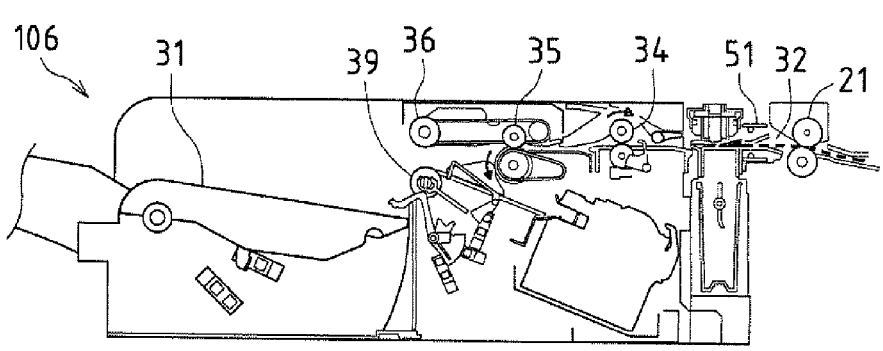
FIGS. 3A to 3D are diagrams showing an operating procedure of a post-processing apparatus when a paper stapling process or the like is not performed.
Figure 3B:
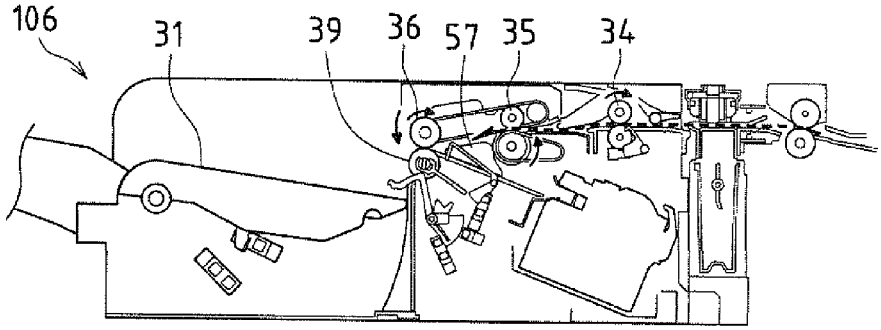

When a print process is performed by the printer unit 103, the inlet rollers 34 and the conveyance roller 35 are driven and rotated as shown in FIG. 3A, and the post-processing apparatus 106 is ready to receive paper. In such a state in which the post-processing apparatus 106 is ready to receive paper, when paper is conveyed from the paper discharge rollers 21 through the inlet 32, and the leading edge of the paper is detected by the inlet sensor 51, the discharge roller 36 is moved down to press against the idler roller 39 as shown in FIG. 3B, then, the discharge roller 36 starts to drive and rotate, and the conveyance of the paper is continued by the discharge roller 36. Also, each of the guide plates 57 moves in the width direction of the paper to reduce the spacing between the guide plates 57 to less than the paper width, so that the paper slidingly passes over the pair of guide plates 57.

Figure 3C:
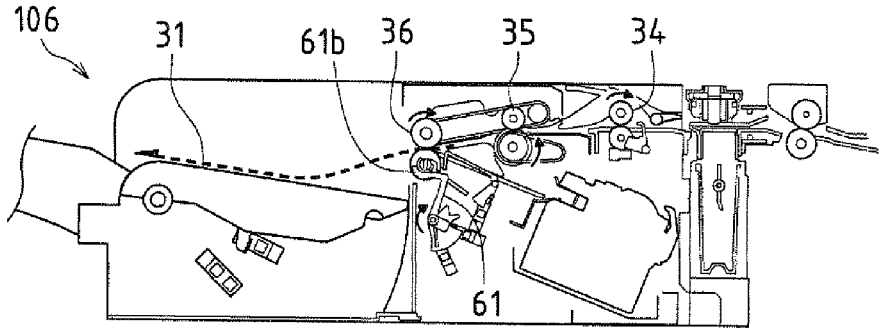

Furthermore, as shown in FIG. 3C, the press lever 61 is controlled so as to swing in a clockwise direction, and the tip 61*b* of the press lever 61 is lifted from the discharge tray 31, so the paper is smoothly discharged onto the discharge tray 31.

Figure 3D:
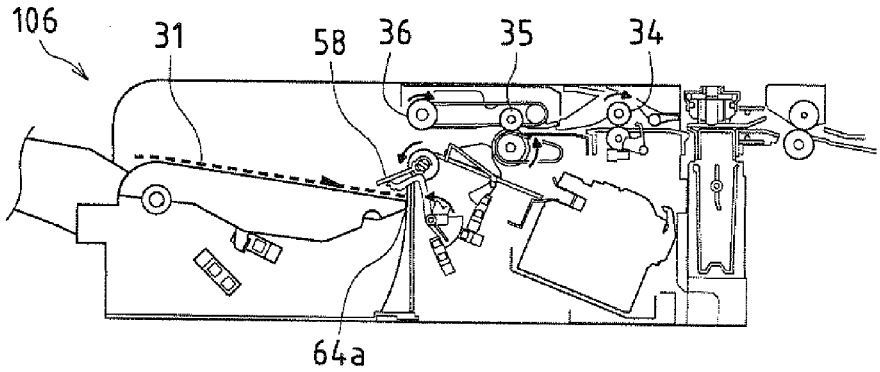

Subsequently, as shown in FIG. 3D, the paddle 58 is driven and rotated in a counterclockwise direction, and the paddle 58 presses against the paper discharged on the discharge tray 31, so the paper is brought into contact with the rear end 64*a* of the discharge tray 31 by the paddle 58. At this time, the discharge roller 36 is driven and rotated in a direction where the discharge roller 36 is spaced apart from the idler roller 39 (in a clockwise direction).

The operations shown in FIGS. 3A to 3D are performed for each sheet of paper, and a plurality of paper sheets are aligned and stacked on the discharge tray 31.

Next, an operation procedure of the post-processing apparatus 106 when a paper stapling process or the like is performed will be described with reference to FIGS. 4A to 4D.

Figure 4A:
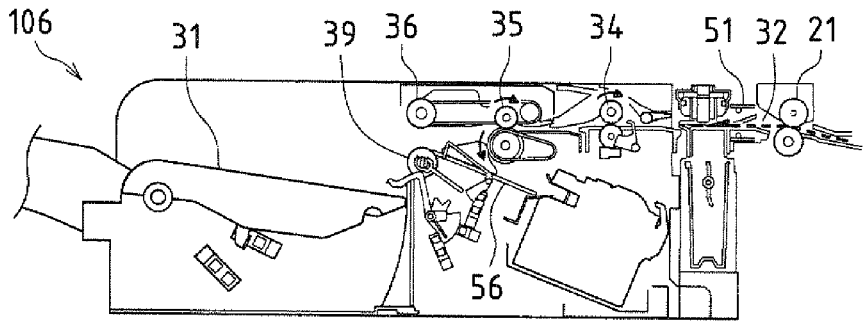
FIGS. 4A to 4D are diagrams showing an operating procedure of a post-processing apparatus when a paper stapling process or the like is performed.

When a print process is performed, as in the case where a stapling process or the like is not performed, the inlet rollers 34 and the conveyance roller 35 are driven and rotated as shown in FIG. 4A, and the post-processing apparatus 106 is ready to receive paper.

Figure 4B:
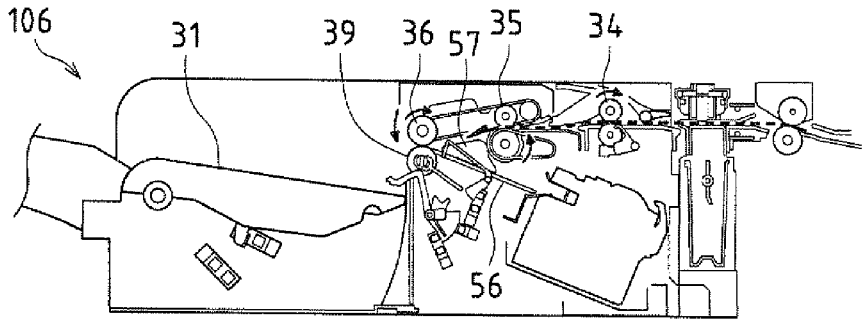

In such a state in which the post-processing apparatus 106 is ready to receive paper, when the first sheet of paper is conveyed from the paper discharge rollers 21 through the inlet 32, and the leading edge of the first sheet is detected by the inlet sensor 51, the discharge roller 36 is moved down to press against the idler roller 39 as shown in FIG. 4B, then, the discharge roller 36 starts to drive and rotate, and the first sheet is conveyed by the discharge roller 36. Also, the pair of guide plates 57 move to fit the paper width, increasing the spacing between the guide plates 57 to slightly greater than the paper width.

After this, the conveyance of paper by the discharge roller 36 stops midway, and the first sheet of paper is placed on the paper placing plate 56, sandwiched between the pair of guide plates 57. Then, the discharge roller 36 is driven and rotated in a clockwise direction, moved upward and spaced apart from the idler roller 39 (illustration omitted).

Figure 4C:
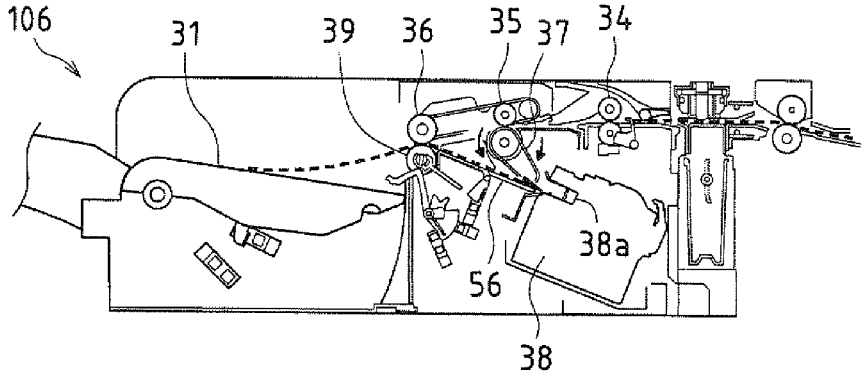

Subsequently, when the second sheet of paper is conveyed, and the trailing edge of the second sheet is detected by the inlet sensor 51 and conveyed by a prescribed distance after the timing of detection, the second sheet of paper is placed on the paper placing plate 56, sandwiched between the pair of guide plates 57. At this time, as shown in FIG. 4C, the discharge roller 36 is again moved down to press against the idler roller 39, and the discharge roller 36 is reversely rotated. Also, the drawing belt 37 is driven and rotated in a clockwise direction, moved down to press against the paper on the paper placing plate 56, and rotates. By doing so, the trailing edges of a stack of paper sheets on the paper placing plate 56 abut a recess portion 38*a* of the stapling unit 38 and, thereby, the paper sheets are aligned. Then, the discharge roller 36 is driven and rotated in a clockwise direction, moved upward and spaced apart from the idler roller 39 (illustration omitted). Afterwards, each time a sheet of paper is conveyed, the discharge roller 36 is temporarily moved down and reversely rotated, and with the discharge roller 36 and the drawing belt 37, the trailing edges of a stack of paper sheets on the paper placing plate 56 abut the recess portion 38*a* of the stapling unit 38 and, thereby, the paper sheets are aligned.

After the trailing edges of a specified number of paper sheets abut the recess portion 38*a* of the stapling unit 38, and the paper sheets are aligned, the trailing edges of the stack of paper sheets are stapled by the stapling unit 38.

Figure 4D:
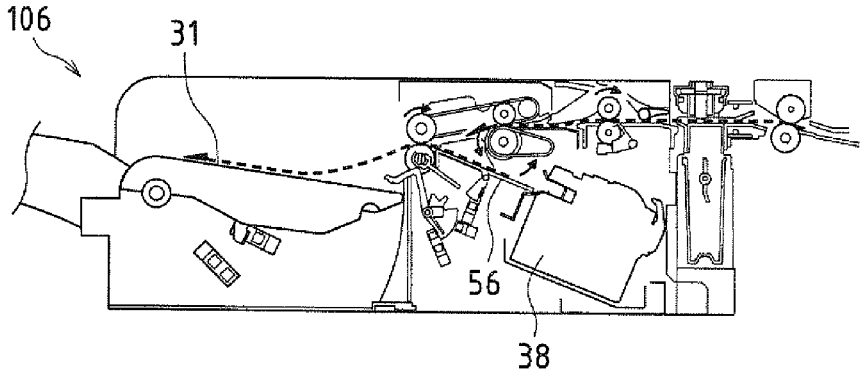

After the stapling process, as shown in FIG. 4D, the discharge roller 36 is driven and rotated in a counterclockwise direction and moved down, the drawing belt 37 is driven and rotated in a counterclockwise direction and moved upward and spaced apart from the paper on the paper placing plate 56. The discharge roller 36 rotates in the forward direction, and the stack of paper sheets on the paper placing plate 56 is discharged onto the discharge tray 31.

The operations shown in FIGS. 4A to 4D are performed for each specified number of paper sheets, and each stack of paper sheets is discharged onto the discharge tray 31.

The punching unit 33 is used to perform a punching process on the paper, and performs a punching process based on the timing at which the leading edge or trailing edge of paper is detected by the inlet sensor 51.

Incidentally, paper often curls because the paper is heated and pressed in the printer unit 103, and such curled paper is discharged via the post-processing apparatus 106 onto the discharge tray 31 of the paper discharge apparatus 107.

To address this, in the paper discharge apparatus 107 of the present embodiment, after such curled paper is received by the discharge tray 31 (after the curled paper is discharged onto the discharge tray 31), the discharge tray 31 is bent to form a ridge such that the curled paper is buckled on the discharge tray 31. By doing so, the curled paper is effectively straightened. As used herein, "ridge" in the discharge tray 31 means that the surface of the discharge tray 31 is in the shape of a ridge.

The configuration of such a paper discharge apparatus 107 will be described next. As shown in FIG. 2, the discharge tray 31 includes a fixed tray 62 that is fixedly disposed spaced apart from the discharge outlet 40 of the post-processing apparatus 106 and a swing tray 64 that is disposed between the fixed tray 62 and the discharge outlet 40 and that is axially supported about the axis 63 disposed near an end portion 62*a* of the fixed tray 62 (i.e., with the axis 63 as the center) so as to be capable of swinging. Although the axis 63 is provided near the end portion 62*a* of the fixed tray 62 in the present embodiment, the configuration is not limited thereto, and the axis 63 may be provided to the end portion 62*a* of the fixed tray 62. By changing the angle of inclination of the swing tray 64 with respect to the fixed tray 62 by a control unit 72 (see the description given below), the fixed tray 62 and the swing tray 64 can be held flat or nearly flat, or the fixed tray 62 and the swing tray 64 can be held in a ridge shape. As used herein, "the fixed tray 62 and the swing tray 64 are held flat or nearly flat" means that the surface of the discharge tray 31, which includes the surface of the fixed tray 62 and the surface of the swing tray 64, is shaped into a flat plane with the plane direction of the surface of the fixed tray 62 and that of the surface of the swing tray 64 brought into the same direction. Likewise, "the fixed tray 62 and the swing tray 64 are held in a ridge shape" means the surface of the discharge tray 31, which includes the surface of the fixed tray 62 and the surface of the swing tray 64, is shaped into a ridge with the plane direction of the surface of the fixed tray 62 and that of the surface of the swing tray 64 in different directions.

A stacked paper height sensor 76 is provided near the lateral portion of the discharge tray 31. This stacked paper height sensor 76 detects the surface of the discharge tray 31 or the height of the top sheet of paper sheets on the discharge tray 31.

Figure 5:
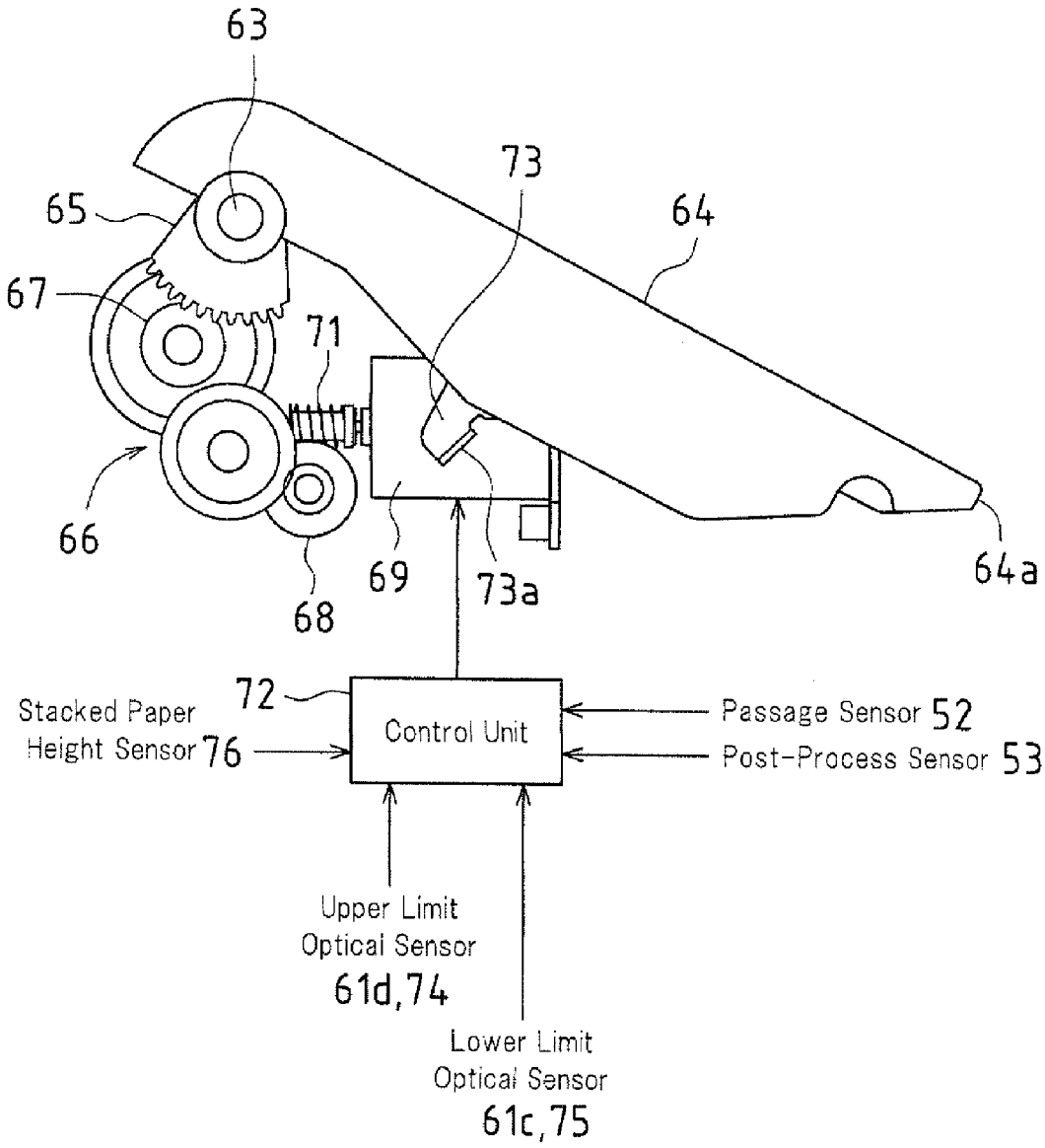
FIG. 5 is a side view showing a structure for swinging and driving a swing tray in a paper discharge apparatus according to an embodiment of the technology.
Figure 6:
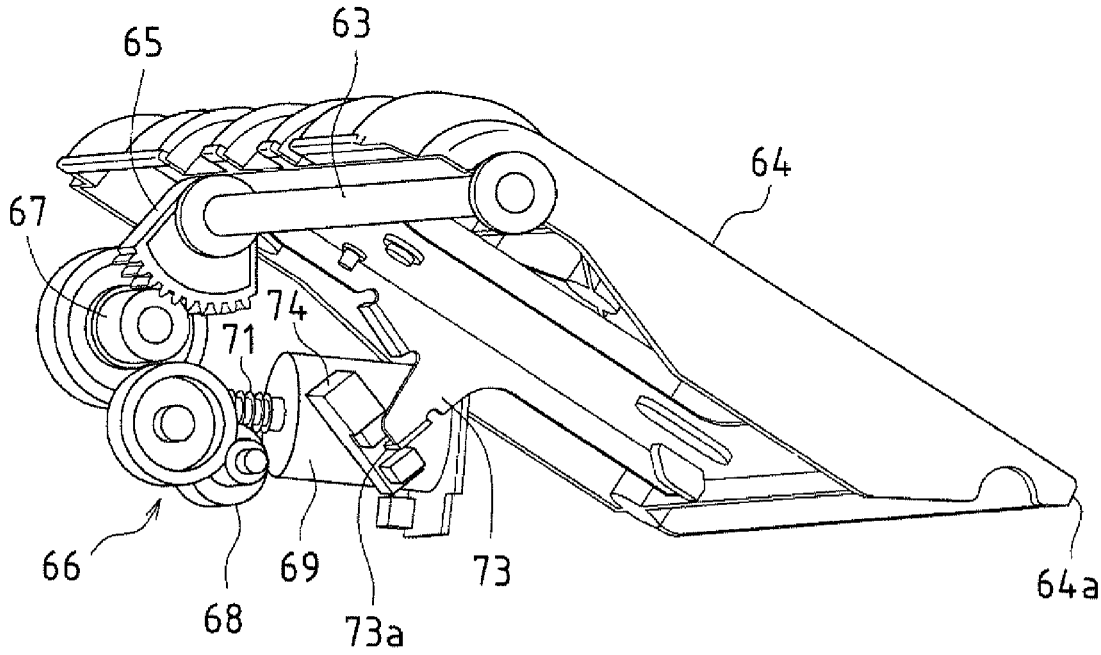
FIG. 6 is a perspective view showing the structure for swinging and driving a swing tray in a paper discharge apparatus according to an embodiment of the technology.

FIGS. 5 and 6 are a side view and a perspective view that show a structure for swinging and driving the swing tray 64. As shown in FIGS. 5 and 6, the swing tray 64 is axially supported by the axis 63. A sector-shaped gear 65 is fixed to the swing tray 64 with the rotation center of the sector-shaped gear 65 overlapping the center of the axis 63. A final gear 67 of a gear unit 66 engages the sector-shaped gear 65, and a worm gear 71 of a motor 69 engages a first gear 68 of the gear unit 66. When the worm gear 71 is rotated by the motor 69, the rotation is transmitted via the gear unit 66 to the sector-shaped gear 65, rotating the sector-shaped gear 65. Along with this, the swing tray 64 swings and rotates about the axis 63 (i.e., with the axis 63 as the center). The motor 69 is driven and controlled by the control unit 72 (referred to herein as a rotation/drive control unit), as a result of which, the swing tray 64 is swung.

Also, a detection target plate 73 is provided protruding from the undersurface of the swing tray 64, and a tip piece 73*a* of the detection target plate 73 is bent at 90 degrees. The tip piece 73*a* of the detection target plate 73 moves in a circular trajectory about the axis 63 (i.e., with the axis 63 as the rotation axis) along with the swing of the swing tray 64. An upper limit optical sensor 74 and a lower limit optical sensor 75 (see FIG. 2) are disposed along the circular trajectory. The upper limit optical sensor 74 and the lower limit optical sensor 75 each include a light-emitting element and a light-receiving element. When the tip piece 73*a* of the detection target plate 73 enters the gap between these elements, the tip piece 73*a* of the detection target plate 73 is detected.

Figure 2:
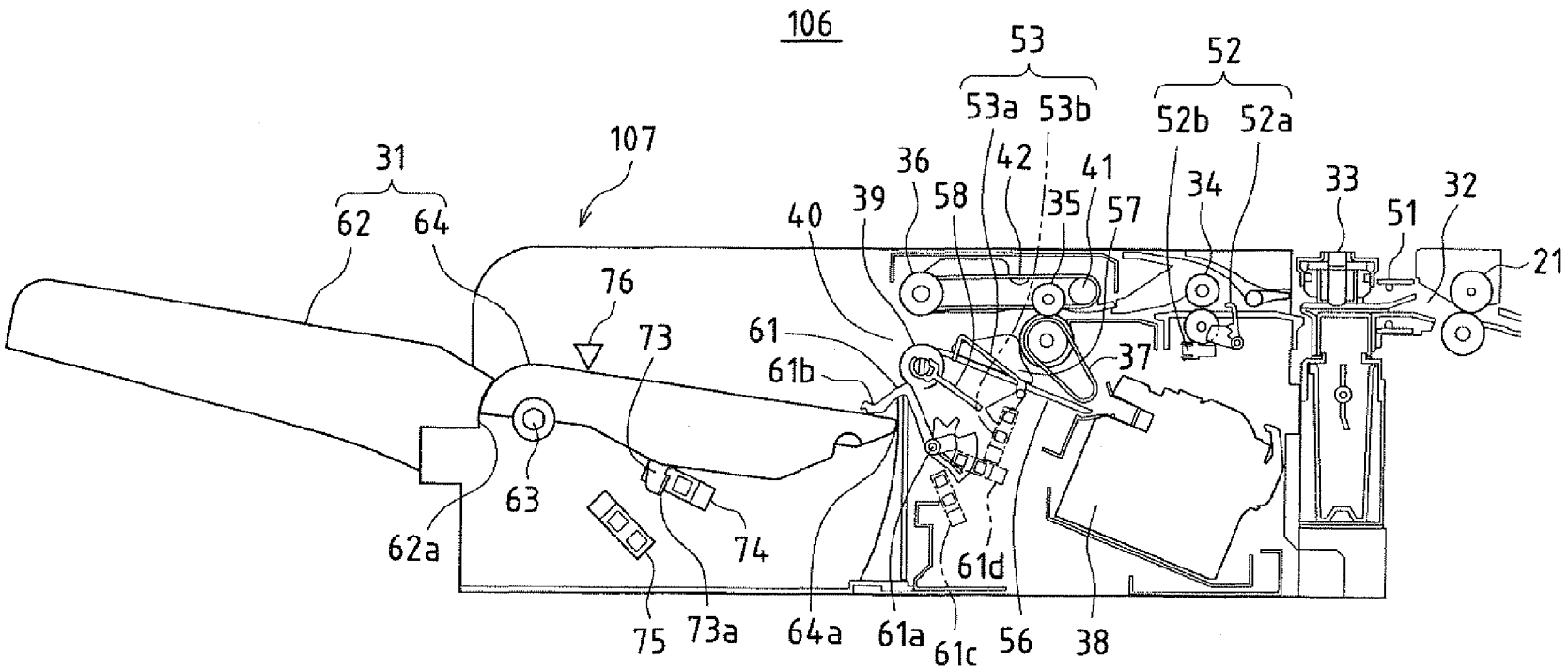
FIG. 2 is an enlarged cross-sectional view of a post-processing apparatus incorporated in the image forming apparatus shown in FIG. 1.

As shown in FIGS. 2 and 5, the control unit 72 inputs the detection outputs of the upper limit optical sensor 74 and the lower limit optical sensor 75 of the swing tray 64, the detection output of the stacked paper height sensor 76, and the detection outputs of the lower optical sensor 61*c* and the upper optical sensor 61*d* of the press lever 61, and drives and controls the motor 69 while monitoring the detection outputs of the sensors 74, 75, 76, 61*c* and 61*d*, so as to adjust the angle of inclination of the swing tray 64 with respect to the fixed tray 62. That is, the control unit 72 that controls the angle of inclination of the surface of the swing tray 64 with respect to the surface of the fixed tray 62 by swinging the swing tray 64 switches and sets the state of the discharge tray 31 between a state before the angle of inclination is changed and a state in which the angle of inclination is changed from that state so as to bend the surface of the swing tray 64 at an inclined angle with respect to the surface of the fixed tray 62.

When the discharge tray 31 before the angle of inclination is changed is empty or nearly empty, the control unit 72 drives and controls the motor 69 to swing and rotate the swing tray 64 about the axis 63 upward until the surface of the discharge tray 31 is detected by the stacked paper height sensor 76 or the upper optical sensor 61*d* of the press lever 61. That is, the swing tray 64 is rotated in a counterclockwise direction with the axis 63 as the center.

Figure 7A:
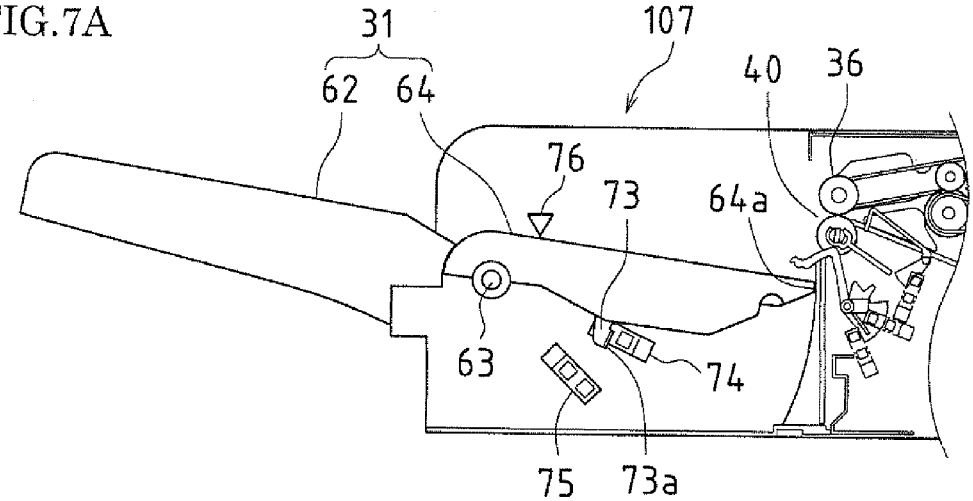
FIG. 7A is a side view showing a discharge tray when being held flat.

At this time (i.e., when the discharge tray 31 is empty or nearly empty), as shown in FIG. 7A, the fixed tray 62 and the swing tray 64, or in other words, the discharge tray 31 is held flat, so a discharge outlet 40 side end portion of the swing tray 64 (specifically, the extremity of the swing tray 64 surface) is positioned close to the discharge outlet 40. Specifically, the surface of the fixed tray 62 and the surface of the swing tray 64 serve as planes having the same plane direction. At this time, the tip piece 73*a* of the detection target plate 73 is detected by the upper limit optical sensor 74, but is not detected by the lower limit optical sensor 75. The control unit 72 determines that the discharge tray 31 is empty or nearly empty based on the detection outputs of the upper limit optical sensor 74 and the lower limit optical sensor 75.

Figure 7B:
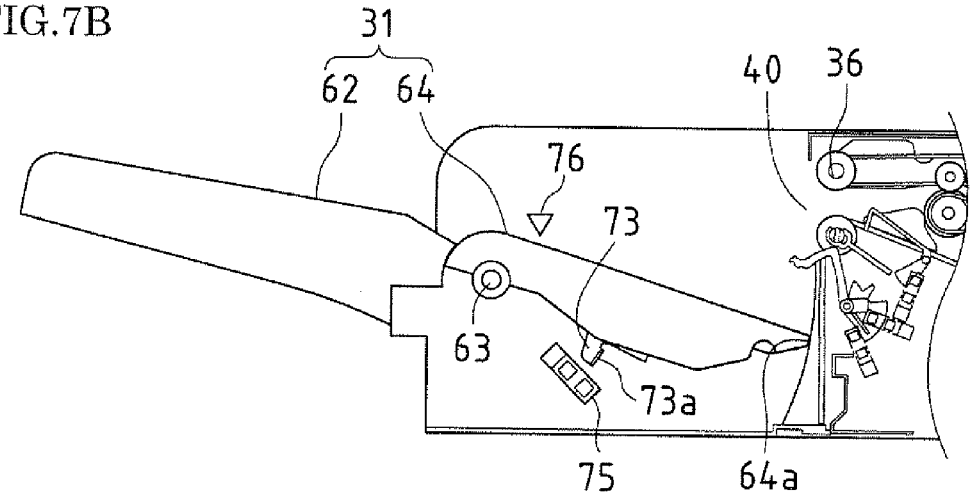
FIG. 7B is a side view showing the discharge tray when being slightly bent.

Also, as the number of paper sheets or the number of stacks of paper sheets that are stacked/stored on the discharge tray 31 increases, the height of paper discharged on the discharge tray 31 (the height of the top sheet of paper sheets from the discharge tray 31) increases accordingly. At this time, the control unit 72 drives and controls the motor 69 so as to swing and rotate the swing tray 64 downward about the axis 63 such that the top sheet of paper sheets on the discharge tray 31 is detected by the stacked paper height sensor 76 or the upper optical sensor 61*d* of the press lever 61. That is, the swing tray 64 is rotated in a clockwise direction about the axis 63 such that the discharge outlet 40 side end of the swing tray 64 (specifically, the extremity of the swing tray 64 surface) is spaced apart from the discharge outlet 40. By doing so, as shown in FIG. 7B, the fixed tray 62 and the swing tray 64 (specifically, the surface of the fixed tray 62 and the surface of the swing tray 64), or in other words, the discharge tray 31 (specifically, the surface of the discharge tray 31) is slightly bent, forming a ridge, and the tip piece 73*a* of the detection target plate 73 is no longer detected by the upper limit optical sensor 74 or the lower limit optical sensor 75. The control unit 72 determines that the discharge tray 31 has been loaded with paper or stacks of paper based on the detection outputs outputted at this time from the upper limit optical sensor 74 and the lower limit optical sensor 75.

Figure 7C:
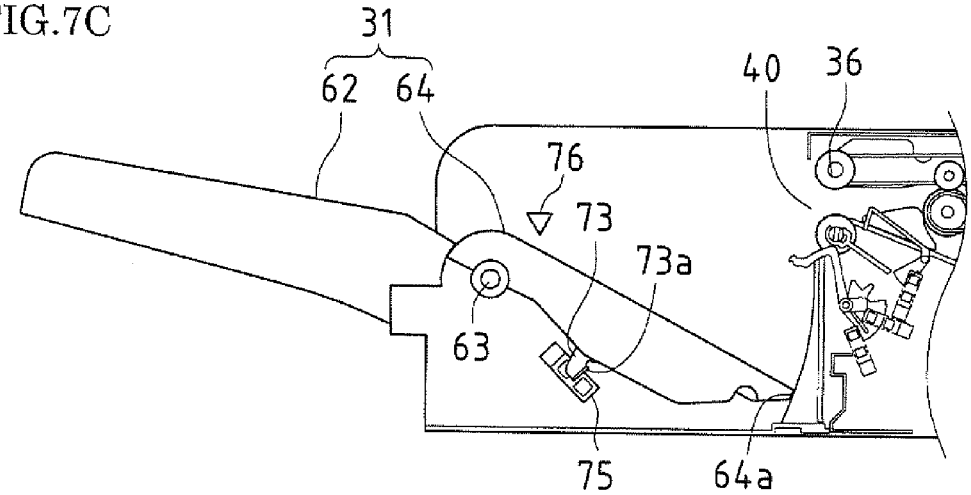
FIG. 7C is a side view showing the discharge tray when being further bent.

If the discharge tray 31 is fully loaded with paper or stacks of paper, the control unit 72 drives and controls the motor 69 to further swing and rotate the swing tray 64 downward about the axis 63 such that the top sheet of paper sheets on the discharge tray 31 is detected by the stacked paper height sensor 76 or the upper optical sensor 61*d* of the press lever 61. That is, the swing tray 64 is further rotated in a clockwise direction about the axis 63 so that the discharge outlet 40 side end portion of the swing tray 64 is further spaced apart from the discharge outlet 40. By doing so, as shown in FIG. 7C, the discharge tray 31 is further bent, and the tip piece 73*a* of the detection target plate 73 is detected by the lower limit optical sensor 75. The control unit 72 determines that the discharge tray 31 has been fully loaded based on the detection outputs outputted at this time from the upper limit optical sensor 74 and the lower limit optical sensor 75.

After this, if the paper or stacks of paper on the discharge tray 31 are removed, the top sheet of paper sheets on the discharge tray 31 is no longer detected by the stacked paper height sensor 76 or the upper optical sensor 61*d* of the press lever 61, so the control unit 72 drives and controls the motor 69 to swing and rotate the swing tray 64 upward about the axis 63 (to rotate the swing tray 64 in a counterclockwise direction about the axis 63), and when the surface of the discharge tray 31 is detected by the stacked paper height sensor 76 or the upper optical sensor 61*d* of the press lever 61, the control unit 72 stops the motor 69 to stop the swing and rotation of the swing tray 64. By doing so, as shown in FIG. 7A, the discharge tray 31 returns to a flat state (the state of the discharge tray 31 before the angle of inclination was changed).

As described above, as the height of the top sheet of paper sheets on the discharge tray 31 increases, the swing tray 64 is further swung and rotated downward about the axis 63 (the swing tray 64 is rotated in a clockwise direction about the axis 63), so paper discharged from the discharge outlet 40 is smoothly discharged without abutting the paper already stacked on the discharge tray 31. In addition, because the trailing edge of the top sheet of paper sheets on the discharge tray 31 is always positioned close to the discharge outlet 40, even if the leading edge of the paper is likely to curl downward, the leading edge of the paper is received on the swing tray 31 before the leading edge of paper discharged from the discharge outlet 40 curls completely and, thus, the leading edge of the paper is flattened on the swing tray 31.

The control unit 72 also monitors the detection outputs of the passage sensor 52 and the post-process sensor 53. When the passage or discharge of a paper sheet or a stack of paper sheets is detected by the sensors 52 and 53, the timing at which the discharge of paper onto the discharge tray 31 finishes is determined. After the completion of paper discharge, the motor 69 is driven and controlled to swing and rotate the swing tray 64 about the axis 63 (to rotate the swing tray 64 about the axis 63), thereby, controlling the angle of inclination of the swing tray 64 with respect to the fixed tray 62 to temporarily bend the discharge tray 31 and, then, the discharge tray 31 is returned to its original state. By doing so, the paper is buckled in a direction perpendicular to the sides of paper, as a result of which, curl in the paper is smoothly loosened.

For example, as shown in FIG. 7A, when the discharge tray 31 is held flat or nearly flat, the swing tray 64 is swung and rotated downward by a prescribed angle (in a clockwise direction) to temporarily bend the discharge tray 31. After that, the swing tray 64 is further swung and rotated upward by the prescribed angle (in a counterclockwise direction) to return the discharge tray 31 to the flat or nearly flat state.

Also, when the discharge tray 31 is bent to form a ridge as shown in FIGS. 7B and 7C, the swing tray 64 is swung and rotated downward by a prescribed angle (in a clockwise direction) to temporarily further bend the discharge tray 31. After that, the swing tray 64 is swung and rotated upward by the prescribed angle (in a counterclockwise direction) to return the discharge tray 31 to its original state.

However, depending on the degree of bending of the discharge tray 31, the swing tray 64 may abut the bottom plate of the paper discharge apparatus 107 when the swing tray 64 is swung and rotated downward (in a clockwise direction) by a prescribed angle. To address this, it is desirable to restrict the angle of downward (clockwise direction) rotation of the swing tray 64. For example, it is possible to adopt a configuration in which the downward (clockwise direction) swing and rotation of the swing tray 64 is prohibited at the time when the tip piece 73*a* of the detection target plate 73 of the swing tray 64 is detected by the lower limit optical sensor 75, or the angle of downward (clockwise direction) rotation of the swing tray 64 is restricted so as not to exceed a certain angle from the detection time.

For example, when a paper stapling process or the like is not performed as shown in FIGS. 3A to 3D, the control unit 72 monitors the detection output of the passage sensor 52, and when the passage of paper is detected by the passage sensor 52, the control unit 72 determines the timing at which the discharge of paper onto the discharge tray 31 finishes based on the time when the passage of paper is detected and the paper conveyance speed, temporarily bends the swing tray 64 with respect to the fixed tray 62 after the completion of discharge and, then, returns the fixed tray 62 and the swing tray 64 to their original state.

Afterwards, as above, each time a sheet of paper is discharged, the swing tray 64 is temporarily bent with respect to the fixed tray 62 and then returned to the original state.

By doing so, each sheet of paper can be buckled on the discharge tray 31, so curl in the paper is effectively straightened, and the paper is smoothly returned to a flat state.

On the other hand, when a paper stapling process or the like is performed as shown in FIGS. 4A to 4D, the control unit 72 monitors the detection output of the post-process sensor 53, and when the passage of a stack of paper sheets from the paper placing plate 56 is detected by the post-process sensor 53, the control unit 72 determines the timing at which the discharge of the stack of paper sheets onto the discharge tray 31 finishes based on the time when the passage of the stack of paper sheets is detected and the paper conveyance speed, temporarily bends the swing tray 64 with respect to the fixed tray 62 after the completion of discharge and, then, returns the swing tray 64 to the original state with respect to the fixed tray 62.

Afterwards, as above, each time a stack of paper sheets is discharged, the swing tray 64 is temporarily bent with respect to the fixed tray 62 and then returned to the original state.

By doing so, each stack of paper sheets can be buckled on the discharge tray 31, so curl in the stack of paper sheets is effectively straightened, and the stack of paper sheets is smoothly returned to a flat state.

As described above, when the swing tray 64 is bent with respect to the fixed tray 62 to form a ridge after paper is discharged onto the discharge tray 31, the paper is buckled in a direction perpendicular to both sides of the paper, so curl in the paper is smoothly loosened. Curl in both sides of the paper can be smoothly loosened by buckling the paper in a direction perpendicular to both sides. In addition, even when the swing tray 64 is bent with respect to the fixed tray 62 and, immediately after that, returned to the original state, paper is temporarily buckled, so the effect remains the same.

Furthermore, as described earlier, because the trailing edge of the top sheet of paper sheets on the discharge tray 31 is always positioned close to the discharge outlet 40, the curled leading edge of the paper is received directly on the discharge tray 31, and the leading edge of the paper is flattened on the discharge tray 31. Then, by buckling the paper, the loosening of the curled leading edge and trailing edge of the paper is also facilitated. That is, four curled edges or corners of paper can be effectively straightened.

Up to here, a preferred embodiment of the technology has been described with reference to the accompanying drawings, but it is needless to say that the technology is not limited to the examples given above. It is apparent that those skilled in the art can conceive of various modified examples or revised examples within the scope defined by the appended claims, and such examples also fall within the technical scope of the technology.

For example, it is also possible to straighten such curls by, for a plurality or a prescribed number of paper sheets or a plurality or a prescribed number of stacks of paper sheets, temporarily bending the swing tray 64 with respect to the fixed tray 62 and, after that, returning these trays to a flat or nearly flat state so as to collectively buckle the plurality of paper sheets or stacks of paper sheets.

That is, the technology can be embodied and practiced in other different forms without departing from the gist and essential characteristics thereof. Therefore, the above-described embodiments are considered in all respects as illustrative and not restrictive. The scope of the technology is indicated by the appended claims rather than by the foregoing description. All variations and modifications falling within the equivalency range of the appended claims are intended to be embraced therein.

What is claimed is:

1. A paper discharge apparatus that sequentially discharges paper through a discharge outlet, stacks and stores the paper, the apparatus comprising:

a discharge tray including a fixed tray that is fixedly disposed spaced apart from the discharge outlet, and a swing tray that is disposed between the fixed tray and the discharge outlet and that is axially supported so as to be capable of swinging about an axis located at an end portion of the fixed tray or near the end portion of the fixed tray; and a drive control unit that controls an angle of inclination of a support surface of the swing tray with respect to a support surface of the fixed tray by causing the swing tray to rotate around the axis, wherein paper discharged from the discharge outlet is received on the support surface of the fixed tray and the support surface of the swing tray.

2. The paper discharge apparatus according to claim 1, wherein the drive control unit switches and sets a state of the discharge tray between a state before the angle of inclination is changed and a state in which the angle of inclination is changed from that state so as to bend the surface of the discharge tray.

3. The paper discharge apparatus according to claim 2, wherein the state of the discharge tray before the angle of inclination is changed is a state in which the surface of the discharge tray is flat or nearly flat, and an end portion on the discharge outlet side of the swing tray is positioned close to the discharge outlet when the discharge tray is held flat or nearly flat, and the end portion on the discharge outlet side of the swing tray is spaced apart from the discharge outlet when the discharge tray is bent.

4. The paper discharge apparatus according to claim 2, wherein the drive control unit temporarily switches the state of the discharge tray from a state before the angle of inclination is changed to a state in which the surface of the discharge tray is bent each time paper is discharged from the discharge outlet and, after that, switches the state of the discharge tray back to the state before the angle of inclination is changed.

5. The paper discharge apparatus according to claim 2, wherein the drive control unit temporarily switches the state of the discharge tray from a state before the angle of inclination is changed to a state in which the surface of the discharge tray is bent when a plurality of paper sheets are discharged from the discharge outlet and, after that, switches the state of the discharge tray back to the state before the angle of inclination is changed.

6. The paper discharge apparatus according to claim 2, wherein each time a sheet of paper is discharged from the discharge outlet, the drive control unit causes the swing tray to move from a first inclined position at which it is inclined with respect to the fixed tray by a first amount to a second inclined position at which it is inclined with respect to the fixed tray by a second greater amount, and thereafter causes the swing tray to move back to the first inclined position.

7. The paper discharge apparatus according to claim 2, further comprising a stacked paper height sensor that senses a height of paper stacked on the discharge tray.

8. The paper discharge apparatus according to claim 7, wherein when the stacked paper height sensor indicates that the height of paper stacked on the discharge tray has exceeded a predetermined height, the drive control unit causes the swing tray to move from its present position to a new position at which an inclination angle between the support surface of the fixed tray and the support surface of the swing tray is greater.

9. A post-processing apparatus for use in an image forming apparatus, comprising the paper discharge apparatus according to claim 1.

10. An image forming apparatus comprising the paper discharge apparatus according to claim 1.

11. The paper discharge apparatus according to claim 1, wherein rotation of the swing tray about the axis varies a spacing between the discharge outlet and an end of the swing tray adjacent the discharge outlet.

12. The paper discharge apparatus according to claim 1, wherein when the support surface of the swing tray is not inclined relative to the support surface of the fixed tray, an end of the swing tray adjacent the discharge outlet is immediately adjacent to the discharge outlet, and wherein when the swing tray is rotated around the axis such that the support surface of the swing tray is inclined relative to the support surface of the fixed tray, the end of the swing tray adjacent the discharge outlet moves away from the discharge outlet.

* * * * *